US008646459B2

(12) United States Patent
Carlson et al.

(10) Patent No.: US 8,646,459 B2
(45) Date of Patent: Feb. 11, 2014

(54) TWO-PLY FABRIC LOW FRICTION INTERFACE

(75) Inventors: J. Martin Carlson, Mora, MN (US); Mark J. Payette, Hugo, MN (US)

(73) Assignee: Tamarack Habilitation Technologies, Inc., Blaine, MN (US)

( * ) Notice: Subject to any disclaimer, the term of this patent is extended or adjusted under 35 U.S.C. 154(b) by 359 days.

(21) Appl. No.: 13/062,878

(22) PCT Filed: Sep. 23, 2009

(86) PCT No.: PCT/US2009/057991

§ 371 (c)(1), (2), (4) Date: Mar. 8, 2011

(87) PCT Pub. No.: WO2010/039524

PCT Pub. Date: Apr. 8, 2010

(65) Prior Publication Data

US 2011/0167532 A1 Jul. 14, 2011

Related U.S. Application Data

(60) Provisional application No. 61/194,091, filed on Sep. 23, 2008.

(51) Int. Cl.

| | |
|---|---|
| ***A61F 13/00*** | (2006.01) |
| ***D04B 7/04*** | (2006.01) |
| ***A41D 13/00*** | (2006.01) |

(52) U.S. Cl.

USPC ..... 128/889; 66/196; 2/69

(58) Field of Classification Search

USPC ..... 2/49.1, 213, 227, 228, 238, 400–407, 2/409; 5/486, 502, 926; 66/196, 197, 202

See application file for complete search history.

(56) References Cited

U.S. PATENT DOCUMENTS

| | | | | |
|---|---|---|---|---|
| 2,641,257 | A * | 6/1953 | Rutledge | 602/67 |
| 4,571,960 | A * | 2/1986 | Hursh et al. | 66/196 |
| 4,615,188 | A * | 10/1986 | Hursh et al. | 66/196 |

(Continued)

FOREIGN PATENT DOCUMENTS

WO 2010123857 A8 10/2010

OTHER PUBLICATIONS

International Search Report, Apr. 30, 2010.

*Primary Examiner* — Patricia Bianco
*Assistant Examiner* — Tarla Patel
(74) *Attorney, Agent, or Firm* — Westman, Champlin & Koehler P.A.; Z. Peter Sawicki

(57) ABSTRACT

A device for reducing friction between a portion of skin of a living being and an object adjoining that portion includes two layers of tricot fabric. Each layer has a shiny side and the shiny sides of the two layers of fabric face each other. Each layer of fabric has a machine direction M, and the layers of fabric are positioned such that the machine direction M of one layer is perpendicular to the other layer. A garment includes a low friction zone and a higher friction zone adjacent the low friction zone, the higher friction zone comprising a material different from a material of the low friction zone. The low friction zone comprises two layers of fabric with their shiny sides, facing each other and their machine directions M oriented perpendicularly. Also described is a method of preventing or treating a skin wound comprising clothing a living being in a garment.

19 Claims, 7 Drawing Sheets

(56) References Cited

U.S. PATENT DOCUMENTS

| | | | | | |
|---|---|---|---|---|---|
| 4,843,844 | A | * | 7/1989 | Hursh et al. | 66/196 |
| 4,873,982 | A | | 10/1989 | Morrison | |
| 5,127,119 | A | | 7/1992 | Rogers | |
| 5,638,558 | A | | 6/1997 | Moore | |
| 5,787,523 | A | * | 8/1998 | Lindberg | 5/81.1 HS |
| 5,799,333 | A | * | 9/1998 | McGarry et al. | 2/161.6 |
| 6,108,820 | A | * | 8/2000 | Bernhardt | 2/239 |
| 6,145,132 | A | * | 11/2000 | Towner | 2/400 |
| 6,918,140 | B1 | * | 7/2005 | Cooper | 2/228 |
| 7,213,420 | B2 | * | 5/2007 | Lynch et al. | 66/186 |
| 7,281,549 | B2 | | 10/2007 | Metzger | |
| 2004/0123391 | A1 | | 7/2004 | Call | |
| 2007/0277282 | A1 | | 12/2007 | Sheppell | |
| 2008/0121305 | A1 | | 5/2008 | Metzger | |
| 2008/0264512 | A1 | | 10/2008 | Metzger | |

* cited by examiner

TWO-PLY FABRIC LOW FRICTION INTERFACE

This Application is a Section 371 National Stage Application of International Application No. PCT/US2009/057991 filed Sep. 23, 2009 and published as WO 2010/039524 A2 on Apr. 8, 2010, the content of which is hereby incorporated by reference in its entirety.

BACKGROUND

The present disclosure generally relates to a specialized clothing device for people who spend long periods of time on support surfaces. The device can be especially useful to people who sit for prolonged periods in a chair and in particular a wheelchair. The device can also be useful to people who lay for extended periods in bed. In addition, the disclosure encompasses methods for custom fabricating and fitting the specialized clothing for users of support surfaces.

When a user has decreased or absent sensation, a particular danger can be the formation of decubitus ulcers (commonly known as "pressure ulcers" or "bedsores"). Decubitus ulcers are lesions that form on parts of the body that are in ongoing contact with objects such as beds or chairs. The symptoms of decubitus ulcers range from skin redness (stage I) to "tunneling ulcers" with necrosis of the skin, fat, muscle and even bone (stage IV). Decubitus ulcers can lead to hospitalization, plastic surgery, and even amputation. Once a patient has had an ulcer with skin scarring, the risk of future ulcers increases.

Wheelchair users can face a truly daunting (and even deadly) challenge in trying to prevent and manage decubitus ulcers. The sitting position of a wheelchair user focuses significant loads on a small area—the buttocks and surrounding areas. Wheelchair users can face a repeating cycle of ulcer formation, hospitalization, surgery, and bed rest. Not only do wheelchair users often sit for prolonged periods, but the physiology of many wheelchair users, such as the elderly, people with spinal cord injuries (SCI), or paraplegics, makes them more prone to ulcer formation. For example, between a third and a half of people with spinal cord injuries—most of whom use wheelchairs—develop ulcers within five years after the injury. Five to seven percent of people with SCI eventually require hospitalization due to decubitus ulcers, and seven to eight percent of those hospitalized eventually die of complications from ulcers. For wheelchair users, the primary regions of the body affected are generally tissue near weightbearing bony structures such as the sacrum, coccyx, ischial tuberosities, and greater trochanters. When "local factors" such as pressure, shear, heat, and moisture rise, the likelihood of ulcer formation increases.

The repeated insult to the body, however, is only part of the affliction. Hospitalization and long-term bed rest can destroy families and social networks and severely hamper work and leisure. Costs incurred because of decubitus ulcers can be dramatic as well. In some cases, a single patient can incur ulcer-related medical costs that go well beyond one million dollars. Indirect costs such as lost productivity increase this monetary burden. More than 2.5 million pressure ulcers are treated each year in the United States. Estimates put United States expenditures on the treatment of decubitus ulcers as high as $11 billion.

Two forms of external loading play a role in the formation of decubitus ulcers: pressure and shear. Pressure acts perpendicular to the skin surface and produces ischemia. Friction forces act parallel (or tangentially) to the skin surface and produce shear strains within the skin and underlying tissue. Although pressure and shear harm skin by separate mechanisms, both can cause ischemia and thereby reduce the vascular supply to tissue. Studies suggest that shear plays a more significant role in causing ulcers in cases of static, non-repetitive loading of human and animal skin.

Many developers of seat cushions have used various techniques to manage pressure to help prevent the formation of decubitus ulcers. Typically, developers have tried to even out pressures across the entire area of the body in contact with the seat cushion. This is sometimes described as "floatation." Many efforts to control peak pressure involve foam materials that can undesirably accelerate ulcer formation by impeding heat dissipation and moisture evaporation.

The purpose of the devices and methods of the present disclosure is to overcome the shortcomings and limitations in the prior art.

SUMMARY

In one aspect, a device is disclosed that reduces friction between a portion of skin of a living being and an object proximate that portion of the skin. The device comprises two layers of tricot fabric. Each layer has a shiny side, and the shiny sides of the two layers of fabric face each other. Each layer of fabric has a machine direction, and the layers of fabric are positioned such that the machine direction of one layer is perpendicular to the other layer.

In another aspect, a garment comprises a low friction zone and a higher friction zone adjacent the low friction zone, the higher friction zone comprising a material different from a material of the low friction zone. The low friction zone comprises two layers of fabric. Each layer has a shiny side, and the shiny sides of the two layers of fabric face each other. Each layer of fabric has a machine direction, and the layers of fabric are positioned such that the machine direction of one layer is perpendicular to the other layer.

In yet another aspect, a method of preventing or treating a skin wound comprises clothing a living being in a garment, the garment comprising a low friction zone and a higher friction zone adjacent the low friction zone, the higher friction zone comprising a material different from a material of the low friction zone. The low friction zone comprises two layers of fabric. Each layer has a shiny side, and the shiny sides of the two layers of fabric face each other. Each layer of fabric has a machine direction, the layers of fabric are positioned such that the machine direction of each layer is perpendicular to the other layer.

BRIEF DESCRIPTION OF THE DRAWINGS

The disclosed subject matter will be further explained with reference to the attached figures, wherein like structure or system elements are referred to by like reference numerals throughout the several views.

DETAILED DESCRIPTION OF ILLUSTRATIVE EMBODIMENTS

Figure 1:
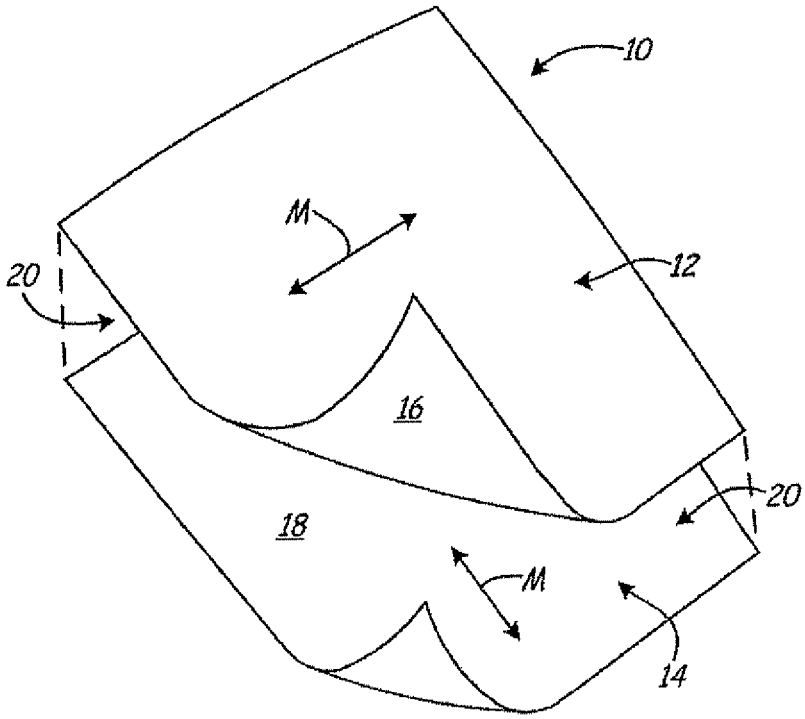
FIG. 1 is a perspective view of an exemplary device incorporating a two-ply system.

The disclosure is directed to a device that comprises a two-ply fabric system for preventing or treating skin trauma on a living being such as a person by reducing friction between the person and an object such as a surface supporting the person. "Two-ply" means that the device has two adjacent layers. As illustrated in FIG. 1, the device generally indicated at 10 includes two layers 12, and 14, each layer being a piece of fabric. One suitable type of fabric is a three-bar tricot fabric consisting of 85% 40-denier semi dull nylon and 15% 140-denier spandex. By tricot is meant a plain warp-knit fabric that is a close-knit design with fibers running lengthwise while employing an inter-loop yarn pattern. The texture of a tricot fabric is different from many other types of fabrics. One side of the tricot fabric features fine ribs running in the lengthwise direction while the other side features ribs that run in the cross-wise direction. Tricot fabric typically has a shiny side and an opposite side that is duller. Tricot knit fabric may be made of materials including, for example, cotton, wool, silk, rayon, nylon, and combinations thereof.

Surprisingly, when the shiny sides 16 and 18 of two pieces of tricot fabric 12 and 14 are placed face-to-face and the two pieces of fabric are oriented such that the machine direction of manufacture M of each piece of fabric is arranged to be perpendicular to that of the other piece, the interface 20 between the two pieces of fabric 12, 14 demonstrates a very low coefficient of friction (COF). For purposes of this application, the machine direction M is defined as that direction in which the fabric, when made, moves forward through a knitting machine. Orienting the two pieces of fabric with each piece's machine direction M positioned perpendicular to the other produces an interface 20 that has a lower coefficient of friction than if the pieces of fabric were positioned such that the machine direction M were parallel (extending in the same direction). The relative orientation of M of the layers 12, 14 need not be arranged precisely perpendicular. When in use, the layers 12, 14 may slide out of a perpendicular relationship. However, the more perpendicular this relationship, the lower the coefficient of friction of the interface 20 will be.

The low COF of interface 20 of the two plies 12, 14 makes device 10 suitable for use as a dressing, patch or as an area on a piece of clothing to reduce friction on an adjacent body area. One suitable material for each of layers 12 and 14 is Style 480 Spandex from Cooper Fabrics of Norwood, Mass. In the case of Style 480 Spandex from Cooper Fabrics, the machine direction M is the same as the direction of the greatest stretch of the fabric. In particular, the coefficient of friction of the Style 480 Spandex at two-ply intersection 20 has been found to be static, dry, and about 0.25 or lower. Style 480 Spandex also has excellent elasticity, with the ability to stretch 270 percent in the M direction and 90 percent in the direction orthogonal to the M direction.

Device 10 may be used by itself as a dressing or it may be incorporated into clothing, garments or other elements interposed between a person's body and various objects. Exemplary clothing can include, for example, a coverall, shorts, underwear, socks, sleeves, hats, shirts, and sweaters. Other elements include, for example, footwear, pillows, bed sheets, and seat cushions. Also, the device 10 may be in the form of a dressing, bandage, plaster that can be applied directly to the skin in a certain region of a body part. For example, the device 10 can be applied as a dressing to part of a foot, such as the toes, the metatarsophalangeal joint, or the heel. In addition, device 10 may be used to treat skin trauma caused by wounds, such as decubitus ulcers, bedsores, diabetic foot ulcers, or blisters.

In an alternative embodiment, at least one of layers 12, 14 is a film made of polytetrafluoroethylene (PTFE) material, a fabric coated with PTFE, a fabric comprising PTFE fibers, or a nylon fabric. The other layer 12, 14 may be made of any material such that the interface 20 between the layers 12, 14 exhibits a low coefficient of friction.

Figure 2:
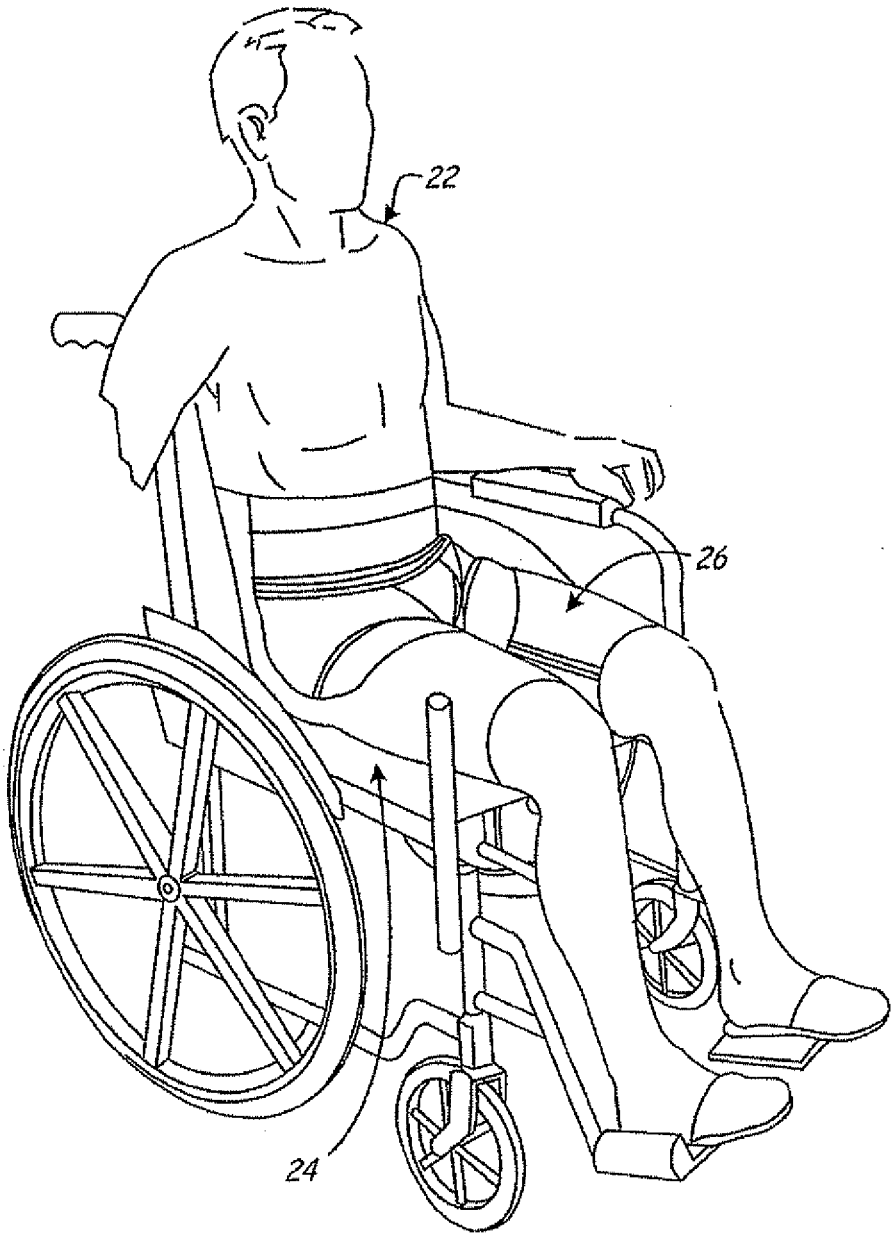
FIG. 2 is a perspective view of a person sitting in a wheelchair wearing a pair of shorts that incorporate an area comprising the device of FIG. 1.
Figure 3:
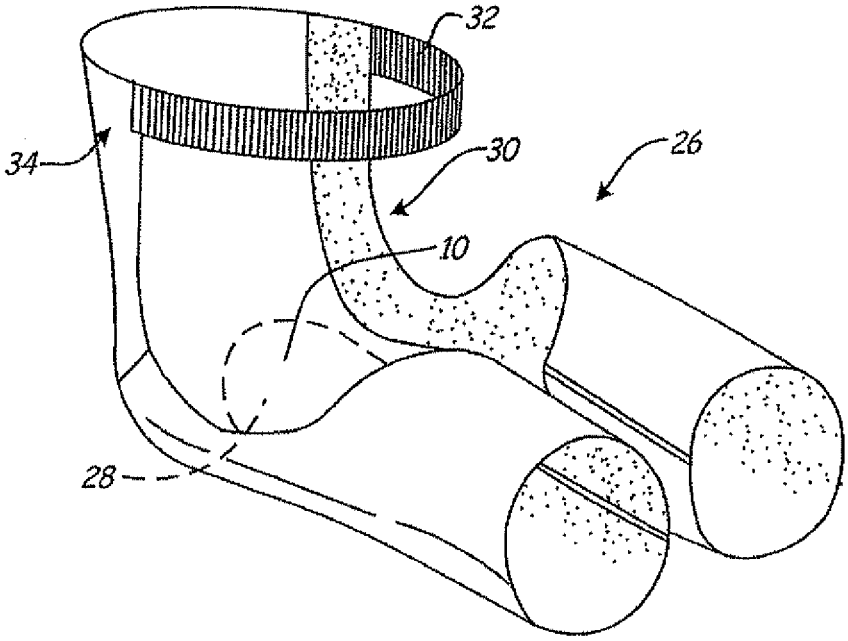
FIG. 3 is a perspective view of the pair of shorts of FIG. 2.

A person 22 sitting on a support surface 24 and wearing a pair of shorts 26 that incorporates the device 10, according to one embodiment of the disclosure, is illustrated in FIG. 2. The pair of shorts 26 incorporates the device 10 in area 28, denoted by a broken line, as illustrated in FIG. 3. The area 28 may be used to prevent skin trauma by allowing the person's body 22 to freely, and with very little friction, move with respect to support surface 24 in area 28, thereby reducing skin damage caused by friction and shear forces. These forces are most likely to cause trauma to the skin at bony prominences or areas of scarred tissue that may come into contact with the support surface 24. The support surfaces 24 can include a wheelchair, footwear, bedding, or any apparatus used to support a living being such as a person.

Figure 4:
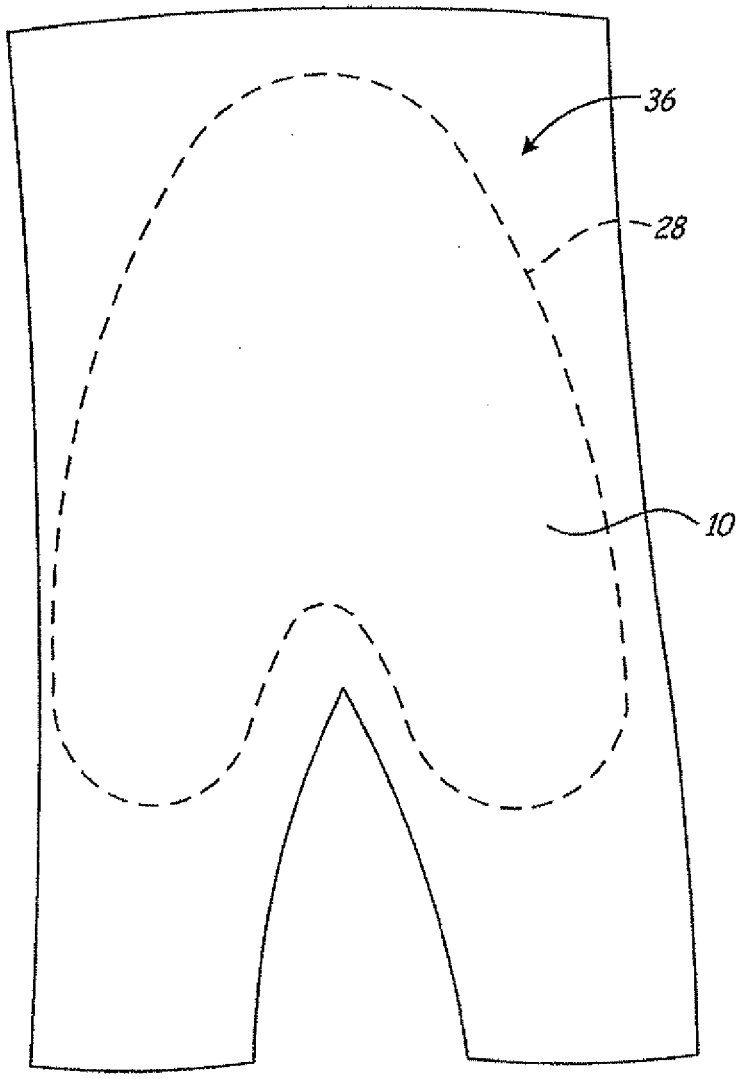
FIG. 4 is a top view of the area of the shorts of FIG. 3 in contact with a support surface.

As illustrated, the front portion 30 of the shorts 26 is open to allow for access to the mid-section of the person's body 22 for toileting or catheter changes, for example. Alternatively, shorts 26 may have a closed front portion. In the illustrated embodiment, shorts 26 have a belt 32 with ends secured to the top portion 34 of the shorts 26 to secure the shorts 26 around the mid-section of a person's body. FIG. 4 is a top view illustrating a portion 36 of shorts 26 that contacts support surface 24. Outside of area 28, shorts 26 may be formed from any suitable material. The two layers 12, 14 of device 10 in area 28 together form a two-dimensional shape having a perimeter (shown in broken lines), wherein the two layers 12, 14 are attached to each other proximate the perimeter. Suitable attachment means include, for example, sewn seams (including elastic seams made with a zig-zag, overlock, or cover stitch), adhesives, ultrasonic welding, and other means or methods.

In an exemplary embodiment, device 10 is not used to construct an entire garment. Rather, it is strategically placed in particular areas of a garment corresponding to parts of the body that are particularly vulnerable to shear stress forces. As illustrated in FIG. 2, as the person 22 sits in the shorts 26 on support surface 24, the two-ply device 10 in permits low friction movement at the interface 20 of the two plies 12, 14 in area 28, thereby reducing skin trauma.

In an exemplary embodiment, device 10 extends throughout the thickness of shorts 26 in area 28 such that one of the layers 12, 14 is in contact with the person 22 and the other layer 12, 14 is in contact with the support surface 24. Because both layers 12, 14 of device 10 are incorporated into the garment, such as shorts 26, this construction allows for the management of friction and shear between a person 22 wearing the garment and the support surface 24 without requiring changes to, or additional materials on, the underlying support surface 24.

Figure 5:
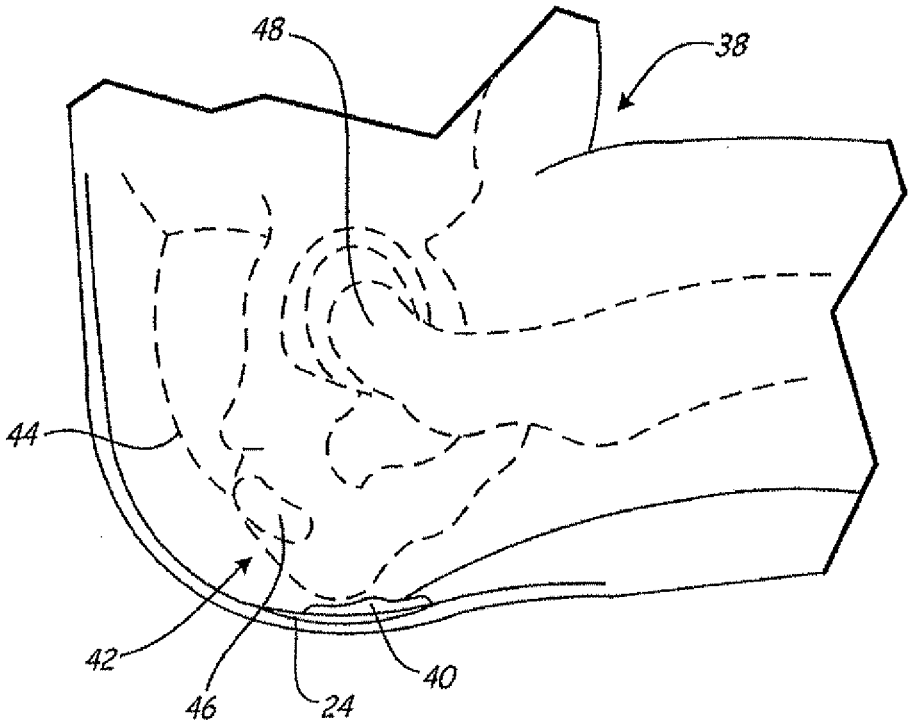
FIG. 5 is a partial, diagrammatic side view of the buttocks area of a person in a seated position.

As illustrated in FIG. 5, the skin and tissue proximate bony prominences in the mid-section 38 of a person's body 22 are vulnerable to the formation of decubitus ulcers 40 when the person 22 spends long periods of time sitting on a support surface 24 such as a wheelchair. Such bony prominences include, for example, an ischial tuberosity 42, a sacrum 44, a coccyx 46, and greater trochanters 48. As illustrated in FIG. 4, area 28 incorporating device 10 into shorts 26 is sized and shaped to protect the person's 22 skin proximate the ischial tuberosities 42 and the coccyx 46.

Figure 6:
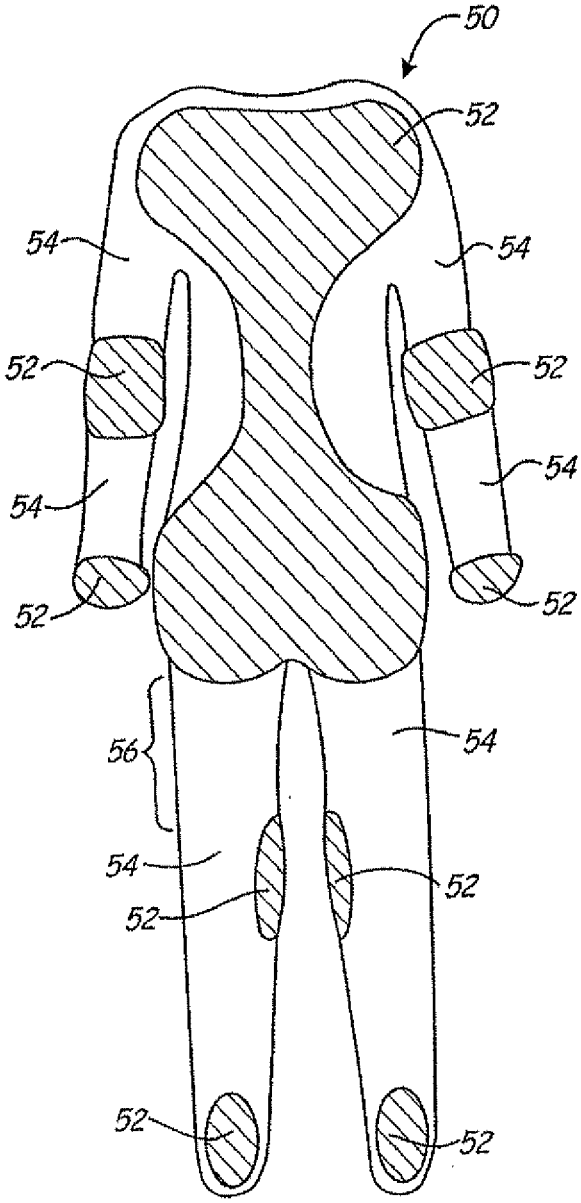
FIG. 6 is a back view of another exemplary garment in accordance with the present disclosure.

Another exemplary garment embodiment is illustrated as coverall 50 in FIG. 6. Other suitable garment embodiments include, without limitation, headwear, shirt, gloves, shorts, leggings and socks, for example. Because coverall 50 covers most of a person's skin, it is suitable for use by people who spend extended periods of time in upright, sitting, reclined, or lying positions. To manage friction and shear between the person 22 and the support surface 24, the coverall 50 comprises two types of zones: low friction zones 52 comprising device 10 and higher friction zones 54 comprising other materials.

Low friction zones 52 comprising device 10 throughout the thickness of the coverall 50 are positioned where zones of low friction between the body 22 and the support surface 24 are desired. Higher friction zones 54 are positioned in areas where skin trauma from friction is of less concern. Moreover, the areas of higher friction zones 54 serve to prevent undesired slippage between the body 22 and the support surface 24. Since friction may be desirable to properly position a person 22 or to retain a person 22 on a support surface 24, friction in specific areas of the body 22 can serve to prevent undesirable sliding or movement. For example, there is often a tendency for a person 22 sitting on a chair to slide forward. Since some sitters may not have the capacity to reposition themselves in the chair, friction can prevent undesirable sliding or movement when it occurs in particular locations. In another example, lying or reclining people can also benefit from the strategic placement of higher friction zones 54 in their garments. For example, higher friction zones 54 can be positioned along the lateral sides of the spinous processes 58, on some parts of the arm, and some parts of the legs. This can prevent a person from sliding out of a bed or sliding out of a reclining position. For example, a hospital bed may be articulated to raise the top portion of the bed. The higher friction zones 58 along the lateral sides of the spinous processes and on the legs of the coverall 50 can help provide traction and prevent slippage of the person on the bed or reclining support surface 24. This can reduce the shear loads transferred to tissues near a bony prominence such as the posterior spinous processes 58. Thus, the coverall 50 allows for the beneficial use of friction in certain areas by incorporating higher friction zones 54.

The higher friction zones 54 of the coverall 50 can be created in a variety of ways. One way to create higher friction zones 54 is to use a single ply of fabric that has a desirably high coefficient of friction with respect to a support surface 24. In an exemplary embodiment, higher friction zone 54 comprises a material that is different from a material of the layers 12, 14 of low friction zone 52. Particularly suitable materials for higher friction zones 54 include, for example, suede leather and moleskin. Moreover, higher friction zones 54 on a coverall 50 need not all be made from the same material. For example, while moleskin may be used on the posterior aspect of the thighs 56, woven textiles may be used for other areas of higher friction zones 54.

Figure 7:
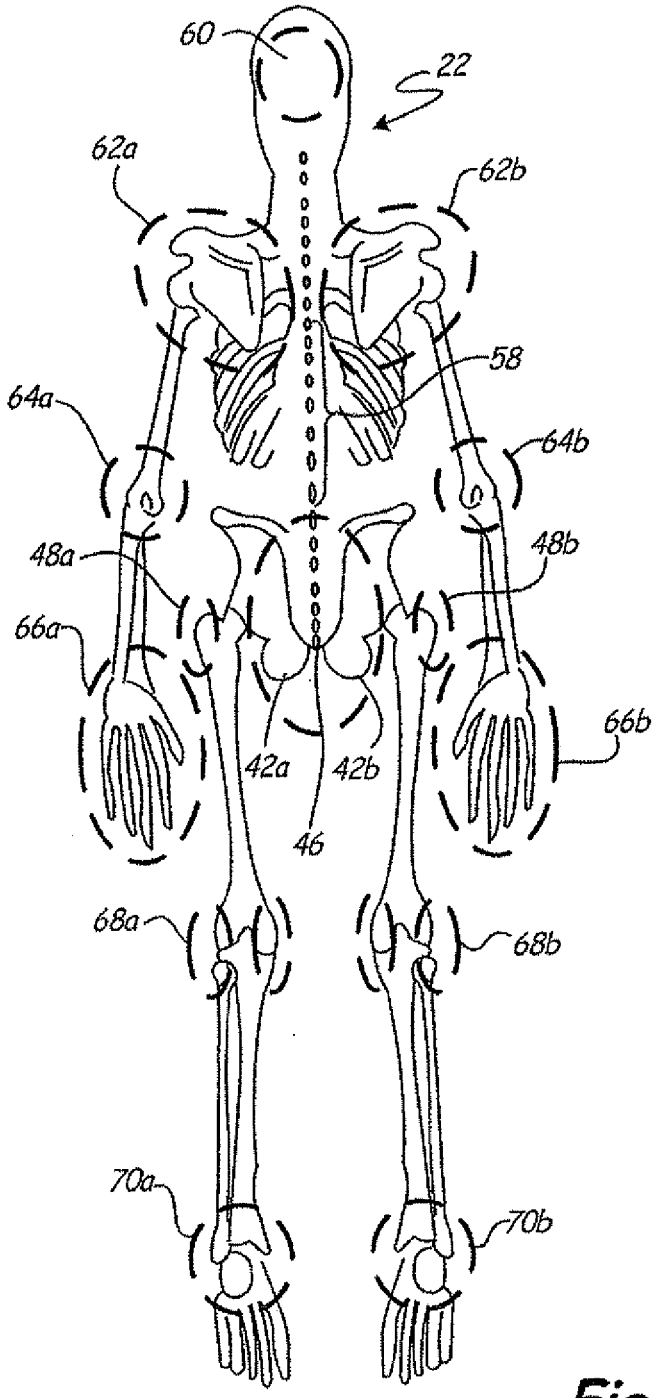
FIG. 7 is a diagrammatic back view of some bony prominences in a person.

Skin and other tissue areas over the bony prominences in a person 22 are usually most susceptible to ulcer formation when the person is sitting, lying, or is in a reclining position. Such bony prominences in a person's body 22, as illustrated in FIG. 7, include, for example, coccyx 46; ischial tuberosities 42*a*, 42*b*; greater trochanters 48*a*, 48*b*; sacrum 44 (illustrated in FIG. 5); posterior spinous processes 58; occipital bone 60; scapulae 62*a*, 62*b*; elbows 64*a*, 64*b*; hands 66*a*, 66*b*; medial aspects of the knees 68*a*, 68*b*; and heels of feet 70*a*, 70*b*. To prevent the formation of decubitus ulcers or heal already formed wounds, a person may be clothed in a garment incorporating low friction zones 52, where such zones 52 are placed adjacent the skin at the bony prominences. The low friction zones may have the shapes described with reference to FIG. 6 or any other shapes that will reduce friction in the areas of tissue vulnerability, especially near bony prominences. Although FIG. 7 illustrates bony prominences in the body of a human being, tissue areas over bony prominences in animals are also susceptible to formation of ulcers and garments can also be designed according to the teachings of this disclosure for non-human living beings.

Although the present invention has been described with reference to preferred embodiments, workers skilled in the art will recognize that changes may be made in form and detail without departing from the spirit and scope of the invention.

What is claimed is:

1. A device for reducing friction between a portion of skin of a living being and an object proximate that portion of the skin, the device comprising:

two layers of tricot fabric, each layer having a shiny side with a close-knit design with ribs running in the cross direction while employing an inter-loop yarn pattern, the shiny sides of the two layers of fabric facing each other, and each layer of fabric having been made in a machine direction, the two layers of fabric being positioned such that the machine direction of one layer is perpendicular to the machine direction of the other layer.

2. The device of claim 1 wherein each of the two layers comprises nylon and spandex.

3. The device of claim 2 wherein each of the two layers comprises about 85% nylon and about 15% spandex.

4. The device of claim 2 wherein the nylon is about 40-denier and the spandex is about 140-denier.

5. The device of claim 1 wherein the two layers together foini a two-dimensional shape having a perimeter, and wherein the two layers are attached to each other proximate the perimeter.

6. The device of claim 5 wherein the two layers are attached to each other via elastic means.

7. A garment comprising:

a low friction zone extending through a thickness of the garment, the low friction zone comprising two layers of fabric, each layer having a shiny side with a close-knit design with ribs running in the cross direction while employing an inter-loop yarn pattern, the shiny sides of the two layers of fabric facing each other, and each layer of fabric having been made in a machine direction, the two layers of fabric being positioned such that the machine direction of one layer is perpendicular to the machine direction of the other layer; and a higher friction zone adjacent the low friction zone, the higher friction zone comprising a material different from a material of the low friction zone.

8. The garment of claim 7 configured to be worn by a human having a bony prominence, wherein the low friction zone is positioned proximate the bony prominence.

9. The garment of claim 7 wherein each of the two layers of fabric comprises a tricot knit.

10. The garment of claim 7 wherein each of the two layers comprises nylon and spandex.

11. The garment of claim 10 wherein each of the two layers comprises about 85% nylon and about 15% spandex.

12. The garment of claim 10 wherein the nylon is about 40-denier and the spandex is about 140-denier.

13. The garment of claim 7 wherein the two layers together form a two-dimensional shape having a perimeter, and wherein the two layers are attached to each other proximate the perimeter.

14. The garment of claim 13 wherein the two layers are attached to each other via elastic means.

15. A method of preventing or treating a skin wound comprising clothing a living being in a garment, the garment comprising:

a low friction zone extending through a thickness of the garment, the low friction zone comprising two layers of fabric, each layer having a shiny side with a close-knit design with ribs running in the cross direction while employing an inter-loop yarn pattern, the shiny sides of the two layers of fabric facing each other, and each layer of fabric having been made in a machine direction, the two layers of fabric being positioned such that the machine direction of one layer is perpendicular to the machine direction of the other layer; and a higher friction zone adjacent the low friction zone, the higher friction zone comprising a material different from a material of the low friction zone.

16. The method of claim 15 wherein the living being is a human having a bony prominence, the method comprising positioning the low friction zone of the garment proximate the bony prominence.

17. A method for preventing or healing skin trauma on a living body and aiding in positioning the body on a support surface comprising identifying a first skin surface susceptible to skin trauma, positioning a low friction covering opposite the skin surface, the low friction covering comprising two layers of fabric, each layer having a shiny side with a close-knit design with ribs running in the cross direction while employing an inter-loop yarn pattern, the shiny sides of the two layers of fabric facing each other, and each layer of fabric having been made in a machine direction, the two layers of fabric being positioned such that the machine direction of one layer is perpendicular to the machine direction of the other layer, identifying a second skin surface not susceptible to skin trauma, and positioning a higher friction covering opposite the second skin surface.

18. The method of claim 17 wherein the first skin surface covers a boney prominence.

19. The method of claim 17 wherein the second skin surface covers a fleshy portion of the body.

* * * * *